United States Patent [19]

Tolleson et al.

[11] Patent Number: 4,603,904

[45] Date of Patent: Aug. 5, 1986

[54] CHAIR WITH ARTICULATED, FLEXIBLE SPRING BACKREST

[75] Inventors: Thomas H. Tolleson; Steve B. Hartzog, both of Morristown, Tenn.

[73] Assignee: Shelby Williams Industries, Inc., Morristown, Tenn.

[21] Appl. No.: 764,557

[22] Filed: Aug. 12, 1985

[51] Int. Cl.[4] ..... A47C 3/00

[52] U.S. Cl. ..... 297/296; 248/629; 267/153; 297/306; 403/223; 403/291; 403/292

[58] Field of Search ..... 297/294, 296, 297, 300, 297/306; 403/223, 224, 291, 292, 298; 267/74, 153; 248/629

[56] References Cited

U.S. PATENT DOCUMENTS

| | | | |
|---|---|---|---|
| 2,404,580 | 7/1946 | Van Schwartz | 403/223 X |
| 2,539,229 | 1/1951 | Colburn | 403/292 X |
| 2,587,822 | 3/1952 | Corning | 297/300 X |
| 4,093,305 | 6/1978 | Staroste | 297/184 |
| 4,333,683 | 6/1982 | Ambasz | 297/300 |

FOREIGN PATENT DOCUMENTS

| | | | |
|---|---|---|---|
| 2619538 | 11/1977 | Fed. Rep. of Germany | 297/296 |

*Primary Examiner*—William E. Lyddane
*Assistant Examiner*—Peter R. Brown
*Attorney, Agent, or Firm*—Silverman, Cass, Singer & Winburn, Ltd.

[57] ABSTRACT

A chair which includes a seat frame having depending leg members and a pair of upstanding, spaced apart members arranged to provide a lower backrest part for the chair and an upper backrest frame part having a pair of spaced apart depending members in registry with the upstanding members, said members being hollow with open extremities, and flexible spring means secured between each pair of members to provide an articulated, flexible spring backrest for the chair. Each flexible spring means includes a molded plastic support strut having a wire cable flexible core to maintain the strut under compression and limit the elongation thereof when a force is exerted on the backrest by a user of the chair.

16 Claims, 7 Drawing Figures

FIG. 1
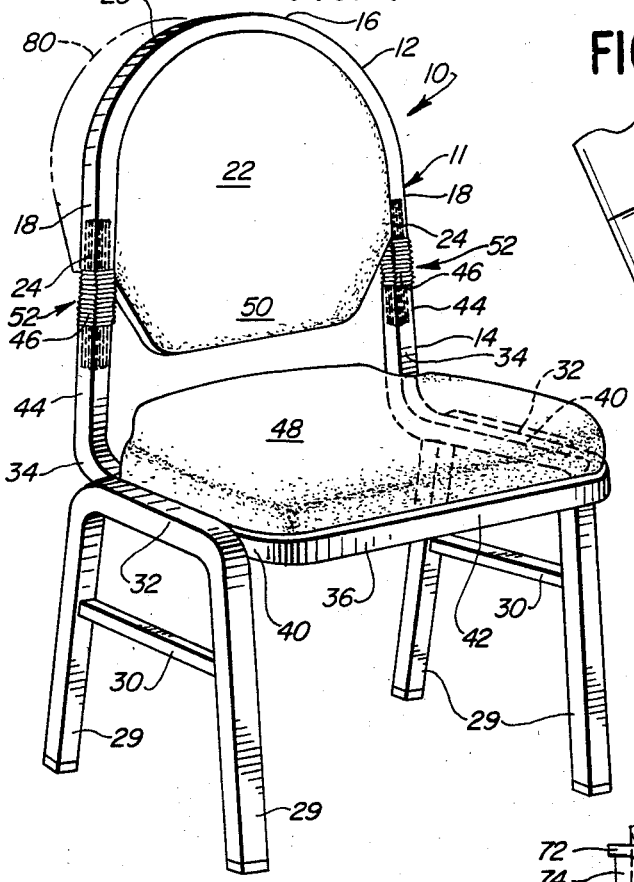
FIG. 2
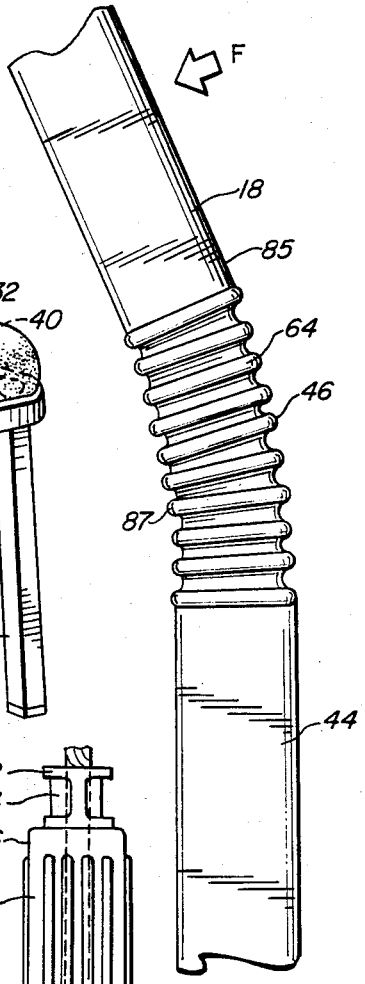
FIG. 3
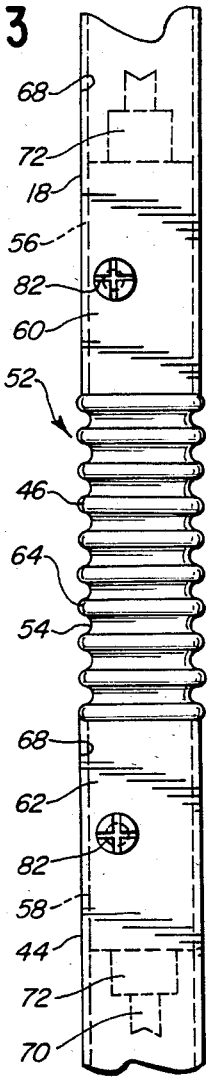
FIG. 4
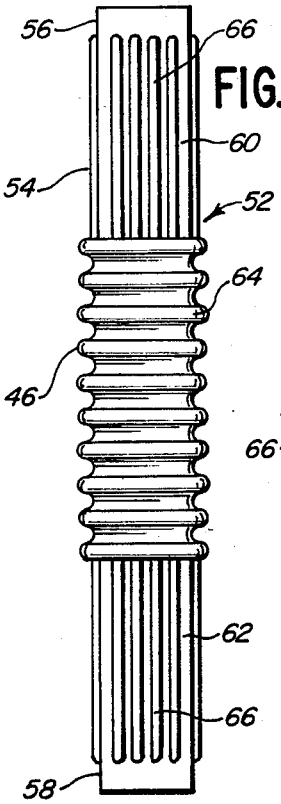
FIG. 5
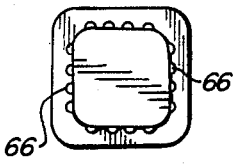
FIG. 6
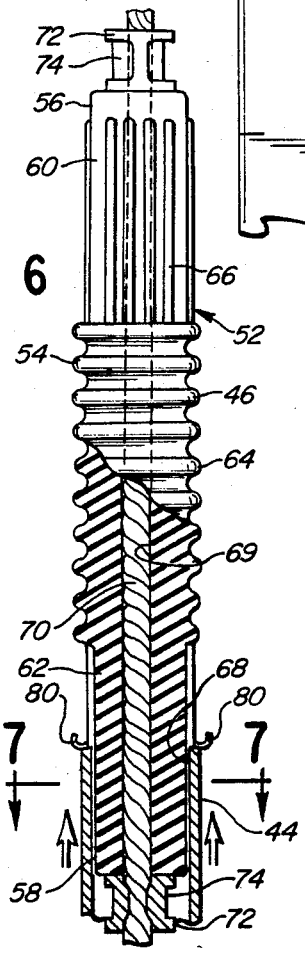
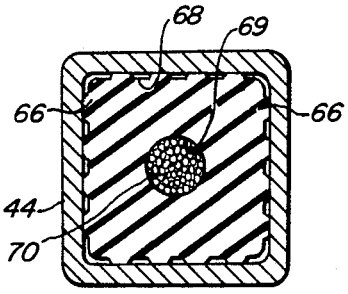
FIG. 7

CHAIR WITH ARTICULATED, FLEXIBLE SPRING BACKREST

BACKGROUND OF THE INVENTION

1. Field of the Invention

This invention relates generally to chairs having flexible, articulated backrests and more particularly, to a novel chair frame having upper and lower backrest frame parts conjoined by flexible spring means.

2. Description of the Prior Art

Chairs having articulated, flexible backrest parts for achieving desired support and comfort for the user are known in the art. Such chairs are used, for example, in banquet and conference facilities where back comfort for the seated attendees is so desirable. Typically, such chairs are stackable and have molded backrest parts and peripheral frame parts of hollow construction to enable interconnection of upper and lower backrest parts which are flexible. Various flexible spring arrangements for joining the upper and lower backrest parts of such chairs are shown in the following U.S. Patents:

| | |
|---|---|
| 2,020,028 | 3,351,378 |
| 2,587,822 | 4,084,850 |
| 2,732,005 | 4,157,203 |
| 3,183,034 | 4,333,683 |
| 3,203,731 | |

The chairs disclosed in the listed patents include articulated, flexible backrests which are of complex construction and relatively involved to install. Simplicity and economy of construction and installation for such chairs which are used in great numbers is a very important and desirable objective. Additionally, it is important to provide a chair construction in which the flexing parts are reliable and capable of repeated use without breaking and which incorporate safety features to prevent sudden failure of the flexable frame parts in the event such parts do fracture or otherwise break after extensive and repeated use. Such safety features are important to prevent possible injury to the user of the chair.

SUMMARY OF THE INVENTION

A chair having a seating frame which includes a lower backrest portion upstanding thereon and an upper backrest frame portion, said backrest portions being interconnected by flexible spring means secured between said lower backrest and upper backrest portions, each spring means including a molded plastic support strut of elastomeric material with a flexible core of sufficient strength to limit the elongation, flexibility and ultimate yield strength thereof.

The upper backrest frame portion includes two lateral, hollow, peripheral depending frame ends, and the lower backrest frame portion has two lateral, hollow, peripheral upstanding frame ends. The depending frame ends are arranged to be aligned, respectively, with the upstanding frame ends. The flexible spring means preferably are installed partially within the interior of the hollow, aligned peripheral frame ends of the backrest portions to extend outwardly from open extremities of said frame ends.

Each spring means comprises a molded plastic elongate support strut with a passageway extending the length thereof. A strong substantially non-extensible (stable in the longitudinal direction,) flexible core member formed from wire cable, chain, linkage, or the like, is positioned within the passageway and secured therein with retaining clamps at opposite extremities of the support strut to hold and maintain the strut under compression. The molded plastic support strut has a centrally-located bellows-like portion between opposite end parts adapted to be inserted into and secured within the respective depending and upstanding frame ends to retain the same together with the spring means secured therebetween.

The opposite end parts of the strut have multiple ribs formed thereon to abut against the inner-facing walls of the frame ends for friction fit of the plastic support strut within the frame ends.

The spring means serve positively to join the upper and lower backrest portions to prevent translational movement therebetween. As the spring means are flexed, the wire cable secured in the passageway of the plastic support strut limits the elongation and ultimate yield or breaking point of the strut. The cable controls elongation of the strut to permit flexing and yet prevents tensile failure by insuring that the plastic support strut is not flexed beyond the tensile limit of the material from which it is constructed.

BRIEF DESCRIPTION OF THE DRAWING

FIG. 1 is a perspective view of a chair embodying the invention and illustrating, in phantom outline, the upper backrest portion in flexed displacement;

FIG. 2 is a fragmentary view of a portion of said chair having the molded plastic elongate support strut of the invention installed thereon and shown in flexed displacement;

FIG. 3 is a fragmentary view similar to that of FIG. 2 illustrating, in phantom outline, portions of the support strut disposed within the frame ends of the chair, and secured therein by optional fasteners;

FIG. 4 is a plan view of the molded plastic elongate support strut of the invention;

FIG. 5 is an end view of the strut shown in FIG. 4;

FIG. 6 is a partially fragmentary view of said support strut with a wire cable positioned and secured within the passageway thereof, and illustrating the manner in which an end of the strut is friction-fit within a frame end of the chair; and FIG. 7 is a sectional view taken along the line 7—7 in FIG. 6,in the direction indicated generally.

DESCRIPTION OF THE PREFERRED EMBODIMENT

Referring to FIG. 1, the chair embodying the invention is designated generally by the reference character 10. Chair 10 includes a frame 11 having an upper backrest portion designated generally 12 and a unitary seat and lower backrest portion designated 14.

The upper backrest portion 12 includes a peripheral, inverted U-shaped frame member 16 providing a pair of spaced apart, depending frame member ends 18 connected across the upper ends thereof by the curved bridging segment 20. A backrest pad or cushion 22 is secured between the frame member ends 18 in a connectional manner. The lower extremities 24 of each frame member end 18 are open or hollow. The frame member 16 is formed of metal stock or tubing, the cross-sectional configuration. of which can be rectangular, circular or any other suitable configuration. Strong molded synthetic plastic or composition materials also are feasible so long as they are rigid and hollow. Also, the precise configuration of the upper portion of frame member 16 forms no part of this invention; any suitable configuration other than the U-shape illustrated may be used.

The unitary seat and lower backrest portion 14 includes a unitary frame assembly formed of hollow tubular stock similar to that of frame member 16. The assembly includes a pair of like inverted U-shaped members, each providing a pair of depending legs 29 braced by a cross-member 30 in a conventional manner. Each pair of leg 29 is connected by an upper saddle or bridge segment 32. The bridging segments 32 are spaced apart the distance between the conjoined leg pairs 29.

A combination seat and lower backrest frame 34 is secured between the bridging or saddle parts 32. The combination frame 34 likewise is formed of tubular stock and includes a horizontally oriented seat-retaining portion 36 of generally U-shaped configuration and an upstanding backrest portion formed as an extension of the seat portion 36. The seat portion 36 includes a pair of side segments 40 connected at the front end of the chair by front segment 42. Extending upwardly from each segment 40 at the rear end of the chair are straight segments 44 which are hollow and open at their respective upper extremities 46, The segments 44 are arranged in parallel relationship and spaced apart laterally the same distance as the depending frame member ends 18. The upstanding segments 44 thereby cooperate to provide the lower backrest frame portion of the chair 10. As seen in FIG. 1, the members 18 and 44 are interconnected, i.e., each member 18 is aligned and in registry with a respective member 44. The joint or juncture between each of the interconnected members 18 and 44 is concealed by a bellows-like appearing flexible sleeve 46 so that the backrest 12 of the chair appears to be unitary. A seat pad or cushion 48 is installed on the seat frame members 40 and 42, and an optional lower backrest pad 50 is installed between the lower backrest segments 44. The chair construction is such that lower backrest pad 50 may be omitted, if desired, without sacrificing the utility of the chair.

The flexible spring means for cojoining or interconnecting the upper and lower backrest parts is designated generally 52. A pair of identical spring means 52 is utilized as seen in FIG. 1, so only one need be described in detail. Each spring means includes a molded plastic support strut 54 of generally elongate configuration with opposite terminal ends 56,58. The cross-sectional configuration bf strut 54 is rectangular to conform to the configuration of the frame parts of chair 10. It is to be understood, however, that the configuration could be other than rectangular and need only be suitable to be engageable in the chair frame portion as described hereinafter.

Strut 54 has a centrally-located bellows like portion 46 disposed between opposite end parts 60,62. Portion 46 has a plurality of radially projecting circumferential ribs 64 spaced along the surface thereof. End parts 60,62 are adapted to be disposed within the hollow frame ends of the upper and lower backrest portions 18,44 with portion 46 exposed therebetween as seen in FIGS. 1,2, and 3. Each end part 60,62 has a plurality of axially-extending ribs 66 formed on the external surface thereof to provide an interference fit with the inner-facing walls 68 of frame parts 14,44 so as to facilitate tight or friction engagement between the end parts 60,62 when they are positioned within frame parts 18,44.

Strut 54 includes a longitidinally extending passageway 69 formed through the length thereof to permit positioning of a cable 70 therewithin. Cable 70 may be formed of aircraft wire, chain or other linkage material and terminates beyond the ends 56,58 of strut 54. Cable 70 is retained in passageway 68 by clips 72 which are crimped or otherwise secured at locations 74 and thereby maintain the plastic from which strut 54 is formed under compression. When the cable 70 is secured in place in passageway 68 by clips 72, the cable limits the elongation and ultimate yield or breakage point of strut 54. The terms "wire member" will be used to include all suitable linkage materials referred to herein.

Strut 54 is positioned between frame parts 18,44 by force-fitting end parts 60,62 into the terminal hollow ends 24,46. As this positioning is effected, portions 80 of ribs 66 are sheared off (see FIG. 6) and may be discarded as scrap, thus ensuring a tight, friction-fit of strut 54 within frame parts 18,44. As added assurance for maintaining the assembly of strut 54 within frame parts 18,44, fastners 82 may be inserted through frame parts 18,44 into respective end parts 56,58 of strut 54, as shown in FIG. 3.

The invention is such that chair back 14 may be flexed as desired to accommodate the posture of a person sitting in the chair for extended periods of time. The cross-sectional configuration and length of strut 54 with wire cable 70 therein is selected to be sufficient to limit the elongation, flexibility and ultimate yield strength to allow the chair back to flex and return to the original position without overstressing the elastomeric material from which strut 54 is formed. The cable 70 limits the elongation and ultimate yield point of the plastic strut 54 in that the plastic material from which strut 54 is constructed has a compression strength which is higher than its tensile strength. By positioning the cable in passageway 68 which is located centrally or slightly closer to the larger or front curve 85 of the strut (see FIG. 2), the portions of the strut closer to the rear curve 87 are compressed before the material on the front curve 85 can stretch or elongate. This limits the overstressing of the surface of the elastomeric material.

The chair back should flex approximately 20 degrees rearward when a force of 75 pounds is applied perpendicular to the back at a point 16 inches above the sitting surface. For optimum user comfort, the flex point should be between three (3) and five (5) inches above the sitting surface. Using the following formula, the load applied at the flex point will be: Load = Moment arm length × force 975 Inch lbs = 13 inches × 75 lbs.

This load would be divided between the two struts 54 giving an individual spring loading of 487.5 lbs. The elastic modulus in flexure of the plastic material used must correspond to the required cross section and the above mentioned flexural requirements.

In addition to the above stress requirement (which has been tested cyclically), the struts must withstand a functional test loading of 150 pounds, one time without failure, and a proof loading of 250 pounds, one time without a failure that would cause injury to the chair's occupant. It is on this 250 pound proof loading that the stress requirements are based. These tests are further described in American National Standards Institute, Inc.—Business and Institutional Furniture Manufacturing Associates (BIFMA), ANSI X5 1-1977 Test Standards, Sections 5 and 16.

From page 418 of "The Twenty-First Edition of Machinery's Handbook," the stress in the extreme outer fibers of the spring is calculated to be as follows:

$$\text{Stress in outer fibers} = \frac{6 \times \text{length of moment arm} \times \text{load}}{\text{Width of flex member} \times (\text{thickness of flex member})^3}$$

$$\text{Length of moment arm} = 13 \text{ inches}$$

$$\text{Load} = 250 \text{ lbs}/2 \text{ struts} = 125 \text{ lbs.}$$

$$\text{Width of flexural member} = .690 \text{ in.}$$

$$\text{Thickness of flexural member} = .690 \text{ in.}$$

$$\text{Stress in outer fibers} = \frac{6 \times 13 \text{ in.} \times 125 \text{ lbs} = 9.750 \text{ in lbs}}{.690 \text{ in} \times (.690 \text{ in})^3 = .3285 \text{ in}^3}$$

$$= 29{,}860 \text{ lbs/in}^2$$

The tensile strength of the plastic used in an operating embodiment, DuPont Delrin-Supertough 100ST acetal resin, is given by DuPont at 6,500 psi with an elongation factor of 200% at breakage. By use of a steel cable 70 to control the elongation of the outer fibers, tensile failures are prevented by ensuring that the outer fibers of strut 54 do not exceed the tensile limits of the material.

The flexing or deflection of the central portion 46 of struts 54, as seen in FIG. 2, enables the upper backrest part to be displaced from the normal plane of the backrest assembly or relative to the lower backrest part, as illustrated in phantom outline 80 in FIG. 1. This flexing or displacement of the upper backrest part relative to the lower backrest part is the desired feature for seating comfort by the user. Upon rising from the seat pad 48 or withdrawing from the backrest pad 22, the upper backrest part will return automatically to the normal solid outline condition of the backrest illustrated in FIG. 1.

The simplicity and economy of the spring means 52 and its installation between the upper and lower backrest frame parts can be readily appreciated. Simple tooling and parts are involved. Minor variations in dimensions and configuration of component parts of the invention may occur to the skilled artisan without departing from the scope of the invention as set forth in the appended claims.

1. A chair comprising, a seat assembly which includes a support frame and depending leg members, a lower backrest frame part having a pair of spaced apart frame members upstanding relative to the seat support frame, an upper backrest frame part having a pair of spaced apart depending frame members arranged in registry with the upstanding frame members, said frame members being hollow with open extremities, and spring members secured between each registered pair of frame members to provide an articulated, flexible spring backrest for the chair, each spring means including a molded plastic support strut with an elongate passageway therein, a substantially non-extensible flexible member disposed within said passageway and means securing said flexible member at each end of said passageway so as to maintain the strut under longitudinal compression and limit the elongation thereof when a force is exerted on the backrest.

2. A chair as claimed in claim 1 in which the flexible member is a metal wire member secured within said passageway by fastening means affixed to the wire member proximate opposite ends of the strut.

3. A chair as claimed in claim 2 in which the strut includes a centrally located bellows-like portion disposed between opposite end parts, said spring means being secured between the registered pair of frame members with the end parts disposed within the frame members and the bellows-like portion positioned between the frame members.

4. A chair as claimed in claim 3 in which the opposite end parts have a plurality of axially-extending ribs formed on the external surface thereof, said ribs being adapted to cooperate with the inner-facing walls of said frame members to provide an interference fit between the strut and the frame members in the installed position thereof.

5. A chair as claimed in claim 4 in which portions of said ribs are sheared off when the strut is positioned within said frame members.

6. A chair as claimed in claim 3 including fasteners positioned between the frame members and the strut to maintain assembly thereof.

7. A chair as claimed in claim 2 in which said fastening means are clips which are crimpled to said wire member.

8. A spring member for use in a flexible backrest assembly for a chair, the assembly including a lower backrest frame part and an upper backrest frame part, said spring member comprising, spring means adapted to be secured between said frame parts, said spring means including at least a molded plastic support strut with an elongated passageway extending substantially the length thereof, a substantially non-extensible flexible insert disposed within said passageway and means securing said insert at each end of said passageway so as to maintain the strut under longitudinal compression and limit the elongation thereof when a bending force is exerted on the spring member.

9. The member as claimed in claim 8 in which the flexible insert is a wire member secured within said passageway by fastening means affixed to the wire member proximate opposite ends of the strut.

10. The member as claimed in claim 9 in which the strut includes a centrally-located bellows-like portion disposed between opposite end parts, said spring means being secured between the frame parts with the end parts disposed within the frame parts and the bellows-like portion positioned between the frame parts.

11. The member as claimed in claim 10 in which the opposite end parts have a plurality of axially-extending ribs formed on the external surface thereof.

12. The member as claimed in claim 9 in which said fastening means are clips which are crimpled to said wire member.

13. A chair comprising, a unitary seat support frame with depending leg members, a lower backrest frame part having a pair of upstanding spaced apart frame members integral with the seat support frame, an upper backrest frame part having a pair of spaced apart depending frame members arranged in registry with the upstanding frame members, said frame members being hollow with open extremities, and spring means secured between each so registered pair of frame members to provide an articulated, flexible spring backrest for the chair, each spring means including a molded plastic support strut with a passageway extending the elongate length thereof, a substantially non-extensible flexible member disposed within said passageway and means securing said flexible member at each end of the passageway so as to maintain the strut under longitudinal compression and limit the elongation thereof when a force is exerted on the backrest.

14. A chair as claimed in claim 13 in which the flexible member is a metal wire member secured within said passageway by fastening means affixed to the wire member proximate opposite ends of the strut.

15. A chair as claimed in claim 13 in which the strut includes a centrally-located bellows-like portion disposed between opposite end parts, said spring means being secured between the registered pair of frame members with the end parts disposed within the frame members and the bellows-like portions positioned between the frame members.

16. A chair as claimed in claim 15 in which the opposite end parts have a plurality of axially-extending ribs formed on the external surface thereof, said ribs being adapted to cooperate with the inner-facing walls of said frame members to provide an interference fit between the strut and the frame members in the installed position thereof.

* * * * *